United States Patent [19]

Kellom

[11] Patent Number: 4,854,093

[45] Date of Patent: Aug. 8, 1989

[54] FIXTURE MOUNT

[76] Inventor: Gary J. Kellom, 3182 Lower Woodland Dr., Colgate, Wis. 53017

[21] Appl. No.: 239,705

[22] Filed: Sep. 2, 1988

[51] Int. Cl.[4] ..... E04F 19/00

[52] U.S. Cl. ..... 52/28; 52/221; 248/56

[58] Field of Search ..... 248/56, 65, 220.2, 223.4, 248/224.4, 225.1, 27.1; 52/220, 221, 28, 211, 212, 173, 518

[56] References Cited

U.S. PATENT DOCUMENTS

| | | | |
|---|---|---|---|
| 2,538,043 | 1/1951 | Roy et al. | 248/56 UX |
| 3,678,635 | 7/1972 | Vagi et al. | 52/28 |
| 4,678,151 | 7/1987 | Radek | 248/220.2 |
| 4,726,152 | 2/1988 | Vagedes et al. | 52/28 |

OTHER PUBLICATIONS

E-Z Block & J-Block Brochure.
Octagon Block & J-Block Brochure.

*Primary Examiner*—Ramon O. Ramirez
*Attorney, Agent, or Firm*—Fred Wiviott

[57] ABSTRACT

A reversible fixture mount for use with siding for a building structure and comprising a pair of mating members, each member including a base having front and rear faces, side walls extending from the base and a flange extending outwardly from the margin of the side walls opposite the base. Each member is a mirror image of the other except for a groove on one member which engages a support on the other to define a lap joint. The support extends from the rear face of the base to a plane defined by the flanges to provide support for the central portion of the base when the flange has engaged the building structure, the front faces of the members defining a second plane parallel to the plane defined by the flanges and the support.

9 Claims, 1 Drawing Sheet

FIG. 1
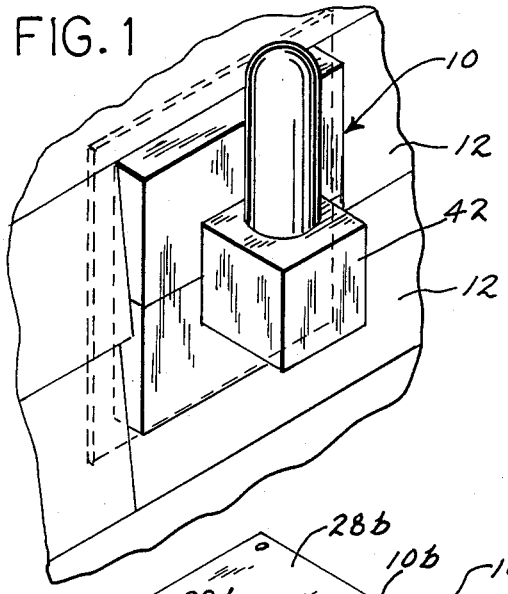
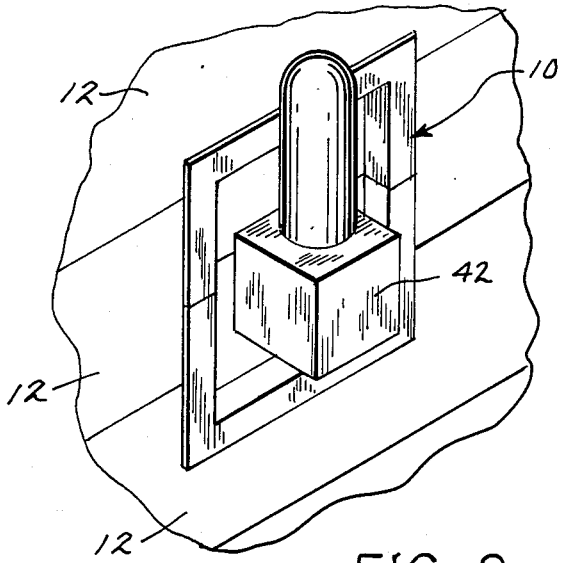
FIG 2
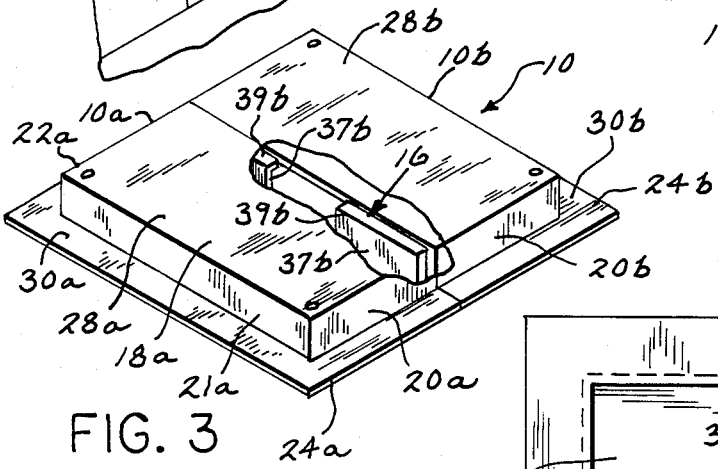
FIG. 3
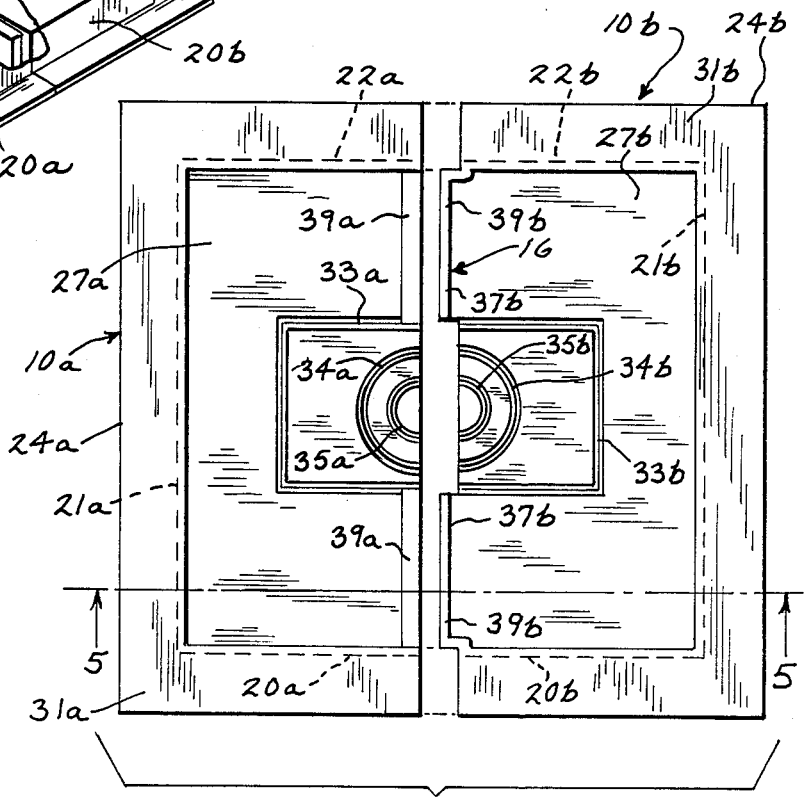
FIG. 4
FIG. 5
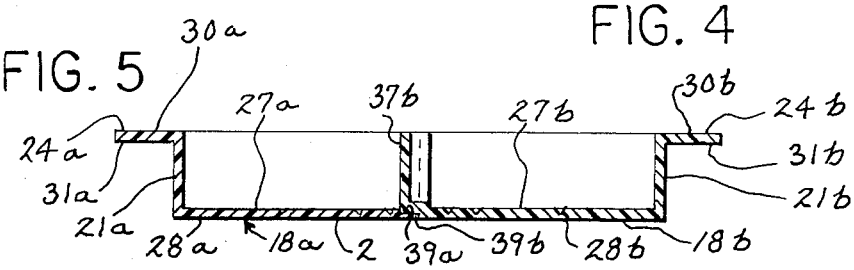

FIXTURE MOUNT

BACKGROUND OF THE INVENTION

This invention relates to fixture mounts for use with siding for building structure and more particularly to a reversible fixture mount which can be used with different types of fixtures.

Siding of metallic materials, such as steel and aluminum or artificial materials, such as vinyl, or natural materials, such as wood are commonly applied to building structures such as homes and small commercial buildings. One type of siding material consists of elongate strips designed to have the appearance of wooden lap board. When such lap siding is applied to an existing structure, it is necessary to accommodate light fixtures, receptacles, water faucets, electrical conduit and the like which extend through the walls of the building. This requires that the siding be cut to accommodate such fixtures, pipes or conduits. It is a common practice to provide a fixture mount which is applied over such fixture openings to provide a fixture support. To accommodate both flush mounted fixtures and those which project from the structure, it was necessary to stock at least two types of mounts.

Fixture mounts usually have center knockouts which can be removed to permit the passage of pipes, conduit and wiring therethrough. However, the use of these prior art fixture mounts often required the removal of the light fixture, water faucet and the like prior to use. This was time consuming and thus relatively expensive. In addition, some installations such as electrical conduit could not be removed and, accordingly, it was necessary to cut the fixture mount prior to application. This cutting operation was also time consuming, caused an unsightly scar on the fixture block and resulted in some wasteage of materials.

SUMMARY OF THE INVENTION

It is an object of the invention to provide a new and improved fixture mount for use with siding for building structures.

A further object of the invention is to provide a fixture mount which can be used with wooden, vinyl and metallic siding materials.

Another object of the invention is to provide a siding fixture mount which does not require removal of the fixture prior to application.

A still further object of the invention is to provide a fixture mount for use with siding for building structures and which results in cost savings relative to prior art fixture mounts.

These and other objects and advantages of the present invention will become more apparent from the detailed description of the preferred embodiment of the invention taken with the accompanying drawings.

In general terms, the invention comprises a reversible fixture mount for use with siding for a building structure and comprising a pair of mating members each having a base defined by front and rear faces and side walls extending therefrom, a flange extending outwardly from the margins of the side walls opposite the base, support means formed on one of the members and extending from the rear face to the plane defined by said flange, and joint means formed on the other member and engaging the first member adjacent said support whereby the center portion of the fixture mount is supported when the fixture mount is mounted with the flanges engaging the structure and the base being displaced therefrom.

BRIEF DESCRIPTION OF THE DRAWINGS

FIG. 1 is a perspective view showing the fixture mount according to the invention mounted in a first mode;

FIG. 2 is a perspective view showing the fixture mount according to the invention with a second mounted in a reversed mode;

FIG. 3 is a perspective view, with parts broken away, of the mount according to the invention;

FIG. 4 is a bottom exploded view of the fixture mount shown in FIG. 3; and FIG. 5 is a view taken along lines 5—5 of FIG. 4.

DETAILED DESCRIPTION OF THE INVENTION

FIG. 1 shows the fixture mount 10 according to the preferred embodiment of the invention mounted in a first mode for supporting a fixture 10 in spaced relation to the siding 12 and FIG. 2 shows the fixture mount 10 mounted in a second mode for supporting a fixture 11 below the surface of the siding 12.

The fixture mount is shown in FIGS. 3, 4 and 5, to include a pair of mating members 10*a* and 10*b* that are preferably mirror images of each other except for the mating portions of a lap joint 16. Accordingly, those portions of the members 10*a* and 10*b* which are identical will be described solely with reference to member 10*a* and identified with reference numerals designated with the letter "a". Corresponding portions of member 10*b* will be identified in the drawings by the same reference numerals designated with the letter "b" but will not be independently described.

The member 10*a* includes a planar base 18*a* and three side walls 20*a*, 21*a*, and 22*a*. The fourth side of member 10*a* is open. A flange 24*a* extends outwardly from the margins of the side walls 20*a*, 21*a* and 22*a* opposite the base 18*a*. The base 18*a* is defined by inner and outer planar faces 27*a* and 28*a*, respectively. The flange 24*a* also has upper and lower surfaces 30*a* and 31*a*, respectively, which define planes parallel to the planar surfaces 27*a* and 28*a* of the base 18*a*. At the center of the open side of surface 27*a* there are a series of grooves 33*a*, 34*a* and 35*a* having shapes and sizes to accommodate one-half of different sized fixtures and pipes. More particularly, groove 33*a* defines an area the size of one-half of a standard electrical junction box while grooves 34*a* and 35*a* are semi-circular to accommodate along one of the grooves depending upon the fixture or pipe with which the mount is to be used.

The lap joint 16 includes a pair of rectangular supports 37*b* integrally formed on member 10*b* and disposed on the opposite sides of the groove 33*b*. Supports 37*b* extend perpendicularly from the base 18*b* to the plane defined by flange face 31*b*. A groove 39*b* is formed at the junction of supports 37*b* and the surface 28*b* of base 18*b*. In addition, complementary grooves 39*a* are formed in member 10*a* at the open edge of surface 27*a*. It will be appreciated that when members 10*a* and 10*b* are mounted with the flanges 24*a* and 24*b* in contact with the structure as shown in FIG. 1, the edge of the supports 37*b* will also engage the structure. This engagement of the supports 37*b* plus the overlapping grooves 39*a* and 39*b* will provide support for the center portion of the fixture mount 10. In addition, the overlapping grooves 39*a* and 39*b* provide a water barrier.

The fixture mount 10 can be mounted with either the flanges 24*a* and 24*b* or the surfaces 28*a* and 28*b* in contact with the structure. More particularly, when employed with a fixture which is mounted adjacent the surface of the siding 12, the flanges 24*a* and 24*b* are mounted against the structure and are overlapped by the siding as shown in FIG. 1. On the other hand, when used with a fixture that is to be recessed relative to the surface of the siding, the surfaces 28*a* and 28*b* are mounted against the structure with the flanges 24*a* and 24*b* overlapping the edges of the siding as shown in FIG. 2. Also, because the fixture mount 10 is formed in two pieces, it can be mounted without removing the fixture 42 shown in FIGS. 1 and 2.

While the fixture mount illustrated in the drawings is generally rectangular in plan view, those skilled in the art will appreciate that it may have any convenient shape, such as a circle, a pentagon, hexagon or an octagon. In addition, while the members 10*a* and 10*b* may be formed of any suitable material, in the preferred embodiment, they were formed of ABS plastic.

While only a single embodiment of the invention has been illustrated and described, it is not intended to be limited thereby but only by the scope of the appended claims.

I claim:

1. A reversible fixture mount for use with siding for a building structure and composing a pair of mating members each having a base defined by front and rear faces and side walls extending therefrom, a flange extending outwardly from the margins of the side walls opposite the base, support means formed on one of the members and extending from the rear face to the plane defined by said flanges, and joint means formed on the other member and engaging the first member adjacent said support, whereby the center portion of the fixture mount is supported when the fixture mount is mounted with the flanges engaging the structure and the base being displaced therefrom.

2. The fixture mount set forth in claim 1 wherein there is a groove formed in the base of each of said members to facilitate the formation of openings in said members so that when said members are in engagement said openings define an opening for a fixture or pipe extending from the structure.

3. The fixture mount set forth in claim 2 wherein there are a pair of supports formed on the first member and on each of the opposite sides of the groove for defining an opening.

4. The fixture mount set forth in claim 3 wherein the side walls of each member define an open ended edge in said base and facing the other member whereby a unitary mount is formed when the members are in engagement, and a first groove is formed on the first member and adjacent the open edge of the base thereof and a second groove formed on the second member adjacent the open edge of the base thereof and complementary to and engagable with the groove in the first member to define a lap joint.

5. The fixture mount set forth in claim 4 wherein the groove in the first member is formed on one of the front and rear faces and the groove on the second member is formed on the other of the front and rear faces to define a lap joint when the members are in engagement.

6. The fixture mount set forth in claim 5 wherein the flanges define a first plane when the members are in engagement and the front face of the base defines a second plane parallel to the first plane, the side walls extending perpendicularly between said planes.

7. The fixture mount set forth in claim 6 wherein said members are each a mirror image of the other except for the grooves which define said lap joint, said grooves being complimentary.

8. In combination with siding for a building structure, said siding comprising long strips of material and having gaps to accommodate fixtures, a reversible fixture mount disposed adjacent said gap and comprising a pair of mating members each having a base defined by a front face engaging said structure and a rear face and side walls extending therefrom, a flange extending outwardly from the margins of the side walls opposite the base and overlapping the gaps in said siding, support means formed on one of said members and extending from the rear face to the plane defined by said flange, and joint means formed on the other member and engaging the first member adjacent said support, said rear faces of said members being constructed and arranged to support a fixture adjacent said structure and recessed relative to said siding.

9. In combination with siding for a building structure, said siding comprising long strips of material and having gaps to accommodate fixtures, a reversible fixture mount disposed adjacent said gap and comprising a pair of mating members each having a base defined by front and rear faces and side walls extending therefrom, a flange extending outwardly from the margins of the side walls opposite the base and engaging said structure, end protions of said siding strips overlapping said flange, support means formed on one of said members and extending from the rear face to the plane defined by said flange, and joint means formed on the other member and engaging the first member adjacent said support whereby the center portion of the fixture mount is supported when the fixture mount is mounted with the flanges engaging the structure and the base being displaced therefrom, the front surfaces of said members being constructed and arranged to support a fixture in spaced relation from said structure and above the surface of the siding.

* * * * *

UNITED STATES PATENT AND TRADEMARK OFFICE

CERTIFICATE OF CORRECTION

PATENT NO. : 4,854,093

DATED : August 8, 1989

INVENTOR(S) : Gary J. Kellom

It is certified that error appears in the above-identified patent and that said Letters Patent is hereby corrected as shown below:

Column 2, line 51, after "accommodate" insert --different sized pipes. In use, a hole is cut in base 18a--.

Column 3, line 30, the word "composing" should read --comprising--.

Signed and Sealed this

Nineteenth Day of June, 1990

*Attest:*

HARRY F. MANBECK, JR.

*Attesting Officer*

*Commissioner of Patents and Trademarks*